US010128094B2

(12) United States Patent
Kalafut et al.

(10) Patent No.: US 10,128,094 B2
(45) Date of Patent: Nov. 13, 2018

(54) OPTIMIZING QUADRUPOLE COLLISION CELL RF AMPLITUDE FOR TANDEM MASS SPECTROMETRY

(71) Applicant: Thermo Finnigan LLC, San Jose, CA (US)

(72) Inventors: Bennett S. Kalafut, San Jose, CA (US); Harald Oser, San Jose, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 80 days.

(21) Appl. No.: 15/446,756

(22) Filed: Mar. 1, 2017

(65) Prior Publication Data

US 2018/0254174 A1 Sep. 6, 2018

(51) Int. Cl.
*H01J 49/26* (2006.01)
*H01J 49/00* (2006.01)
*H01J 49/42* (2006.01)

(52) U.S. Cl.
CPC ..... *H01J 49/005* (2013.01); *H01J 49/0031* (2013.01); *H01J 49/421* (2013.01)

(58) Field of Classification Search
CPC .... H01J 49/005; H01J 49/0031; H01J 49/421; H01J 49/0027; H01J 49/0036; H01J 49/0045; H01J 49/0004
USPC ..... 250/281, 282, 283, 287
See application file for complete search history.

(56) References Cited

U.S. PATENT DOCUMENTS 6,323,482 B1 11/2001 Clemmer et al.
6,534,764 B1 3/2003 Verentchikov et al.
7,189,967 B1 * 3/2007 Whitehouse ..... H01J 49/004 250/292
8,164,053 B2 4/2012 Sugiyama et al.
8,604,419 B2 12/2013 Nolting et al.
9,147,563 B2 9/2015 Makarov
(Continued)

FOREIGN PATENT DOCUMENTS

WO 2007/079589 A1 7/2007

OTHER PUBLICATIONS

Mohan et al., "Calibration Point for Electron Ionization MS/ MS Spectra Measured with Multiquadrupole Mass Spectrometers", J Am Soc Mass Spectrom 1994, 5, 576-582.
(Continued)

*Primary Examiner* — Nicole Ippolito
(74) *Attorney, Agent, or Firm* — David A. Schell

(57) ABSTRACT

A mass spectrometer includes a collision cell and a system controller. The collision cell includes a plurality of rod pairs configured to generate pseudopotential well through the application of radio frequency potentials to the rod pairs. The collision cell configured to generate a target fragment from a parent ion by colliding the parent ion with one or more gas molecules. The system controller is configured to set a radio frequency amplitude of the radio frequency potentials to a default amplitude; monitor the production of a target fragment ion while adjusting the collision energy; set the collision energy to optimize the production of the target fragment ion; apply a linear full range ramp to the radio frequency amplitude to determine an optimal radio frequency amplitude; and set the radio frequency amplitude to the optimal radio frequency amplitude for the parent ion, target fragment ion pair.

19 Claims, 8 Drawing Sheets

(56) References Cited

U.S. PATENT DOCUMENTS

| | | | | |
|---|---|---|---|---|
| 2005/0029441 | A1* | 2/2005 | Davis | H01J 49/0031 250/281 |
| 2005/0063864 | A1* | 3/2005 | Sano | G01N 33/6848 422/68.1 |
| 2007/0145264 | A1* | 6/2007 | Specht | H01J 49/0045 250/292 |
| 2009/0032697 | A1* | 2/2009 | Sugiyama | H01J 49/0045 250/282 |

OTHER PUBLICATIONS

Tanner et al., "Reaction cells and collision cells for ICP-MS: a tutorial review", Spectrochimica Acta Part B 57 (2002), 1361-1452.

* cited by examiner

OPTIMIZING QUADRUPOLE COLLISION CELL RF AMPLITUDE FOR TANDEM MASS SPECTROMETRY

FIELD

The present disclosure generally relates to the field of mass spectrometry including optimizing quadrupole collision cell RF amplitude for tandem mass spectrometry.

INTRODUCTION

Mass spectrometry can be used to perform detailed analysis on samples. Furthermore, mass spectrometry can provide both qualitative (Is compound X present in the sample) and quantitative (how much of compound X is present in the sample) data for a large number of compounds in a sample. These capabilities have been used for a wide variety of analysis, such as to test for drug use, determine pesticide residues in food, monitor water quality, and the like.

Selected Reaction Monitoring (SRM) can provide both qualitative and quantitative information about a particular ionic species within a complex mixture. During SRM, a parent ion of a particular mass is selected and undergoes fragmentation, after which a particular fragment ion mass is selected for detection. Detection of the fragment ion during SRM is highly indicative of the presence of the parent ion in the sample, since it requires a fragment ion of a particular mass-to-charge ratio from a parent ion having a particular mass-to-charge ratio. In contrast, looking for a ion having the same mass-to-charge ratio of the parent ion can lead to false positives from different ionic specifies having a similar mass-to-charge ratio. As such, there is a need for improved systems and methods for SRM.

DRAWINGS

For a more complete understanding of the principles disclosed herein, and the advantages thereof, reference is now made to the following descriptions taken in conjunction with the accompanying drawings and exhibits, in which.

Figure 1A:
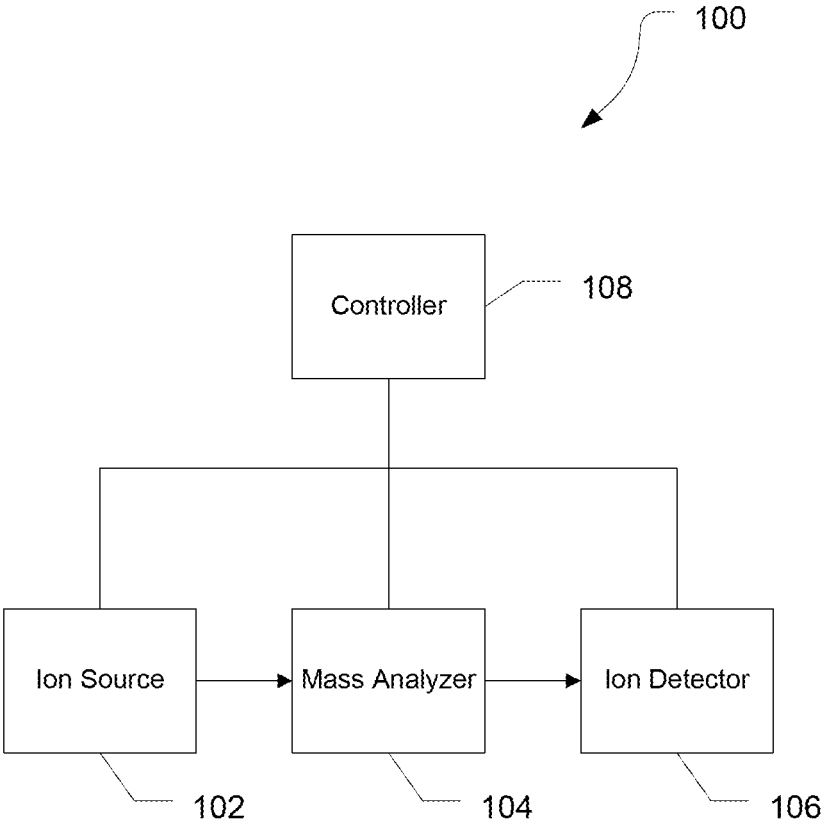
FIG. 1A is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion isolation are described herein and in the accompanying exhibits.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1A. In various embodiments, elements of FIG. 1A can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a quadrupole ion trap analyzer, a time-of-flight (TOF) analyzer, an electrostatic trap (e.g., ORBITRAP) mass analyzer, Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Figure 1B:
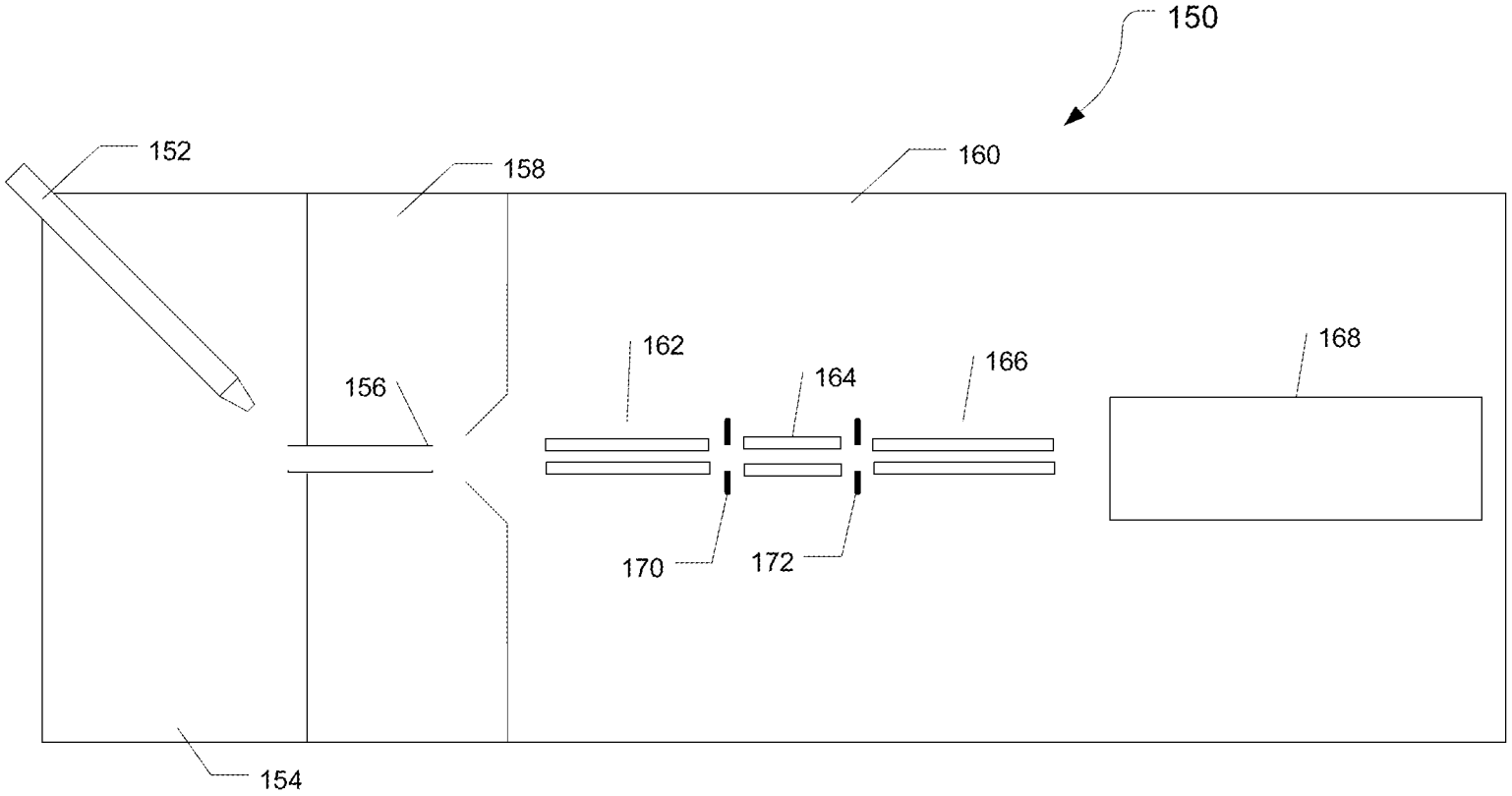
FIG. 1B is another diagram of an exemplary mass spectrometry system, in accordance with various embodiments.

FIG. 1B depicts the components of a mass spectrometer 150, in accordance with various embodiments of the present invention. It will be understood that certain features and configurations of mass spectrometer 150 are presented by way of illustrative examples, and should not be construed as limiting to implementation in a specific environment. An ion source, which may take the form of an electrospray ion source 152, generates ions from an analyte material, for example the eluate from a liquid chromatograph (not depicted). The ions are transported from ion source chamber 154, which for an electrospray source will typically be held at or near atmospheric pressure, through an ion transfer tube 156 to at least one intermediate chamber 158, to a vacuum chamber 160 in which mass analyzer resides.

The mass analyzer can consist of a quadrupole mass filter 162, a collision cell 164, a quadrupole mass filter 166, and a detector 168. Quadrupole mass filter 162 can selectively transport ions of a particular m/z range to the collision cell 164. In various embodiments, the parent ion can have a mass to charge ratio within the m/z range, such that the parent ion is selectively transported to the collision cell 164. Once in the collision cell, the parent ion may be collided with collision gas causing the parent ion to fragment into one or more fragment ions. DC voltages can be applied to entrance lens 170 and exit lens 172 to create potential gradients that can affect the kinetic energy of the ions entering and exiting the collision cell. The quadrupole mass filter 166 can selectively transport a specific fragment ion based on the mass-to-charge ratio, such that fragment ions resulting from a particular transition (parent ion-fragment ion pair) reach the detector.

In various embodiments, a collision gas can be introduced into collision cell 164. The pressure within the collision cell can be regulated by altering the flow of the collision gas into the collision cell.

The operation of the various components of mass spectrometer 150 is directed by a control and data system (not depicted), which will typically consist of a combination of general-purpose and specialized processors, application-specific circuitry, and software and firmware instructions. The control and data system also provides data acquisition and post-acquisition data processing services.

While mass spectrometer 150 is depicted as being configured for an electrospray ion source, it should be noted that the mass analyzer 214 may be employed in connection with any number of pulsed or continuous ion sources (or combinations thereof), including without limitation a heated electrospray ionization (HESI) source, a nanoelectrospray ionization (nESI) source, a matrix assisted laser desorption/ionization (MALDI) source, an atmospheric pressure chemical ionization (APCI) source, an atmospheric pressure photo-ionization (APPI) source, an electron ionization (EI) source, or a chemical ionization (CI) ion source.

Collison Cell Optimization

Figure 2:
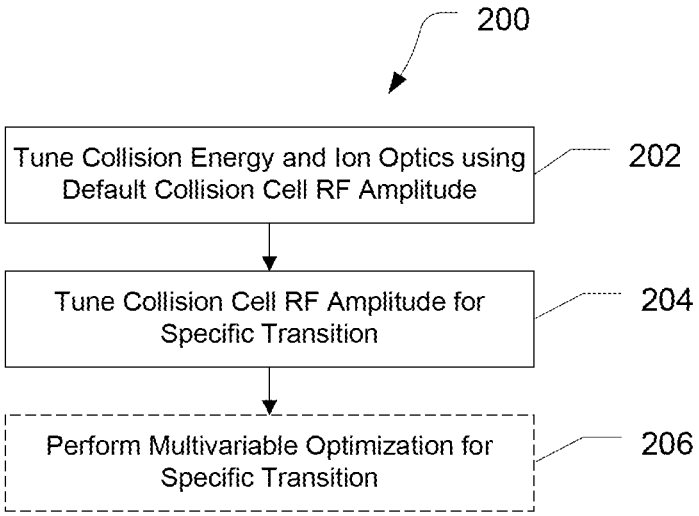
FIGS. 2 and 3 are flow diagrams illustrating exemplary methods for optimizing quadrupole collision cell RF amplitude, in accordance with various embodiments.

FIG. 2 is a flow diagram illustrating a method 200 of tuning collision cell RF amplitude. At 202, the collision energy and ion optics can be tuned for a parent ion-fragment ion pair using a default collision cell RF amplitude. For example, the collision energy and/or ion optics voltages can be adjusted systematically to obtain a maximum ion intensity of the fragment ion. In various embodiments, the default collision cell RF amplitude can be based on an optimum setting for the parent ion, an optimum setting for the fragment ion, or some average of the two.

At 204, the collision cell RF amplitude can be tuned for the specific parent ion-fragment ion pair. For example, holding the collision energy and ion optics fixed, the collision cell RF amplitude can be systematically adjusted to obtain a maximum on intensity for the fragment ion. In various embodiments, the collision cell RF amplitude can be adjusted by ramping, such as a linear ramp, over a range of RF amplitudes. Fitting the intensity data as a function of the RF amplitude can be used to determine an optimum RF amplitude for the parent ion-fragment ion pair.

Optionally, at 206, a multivariable optimization for the parent ion-fragment ion pair transition can be performed. The multivariable optimization can include an entrance lens potential, an exit lens potential, RF amplitude, collision energy, or any combination thereof. In particular embodiments, the multivariable optimization can include the RF amplitude and the collision energy. In various embodiments, the multivariable optimization can be performed using successive iterations of Powell's method until the voltage steps are below a desired tolerance.

In various embodiments, the optimization of the collision cell RF amplitude can be specific to a particular parent ion-fragment ion pair. Additionally, the optimal collision cell RF amplitude can be specific to a collision gas species and/or a collision gas pressure within the collision cell. As such, adjustment of the collision gas species or pressure can require re-optimization of the RF amplitude.

Figure 3:
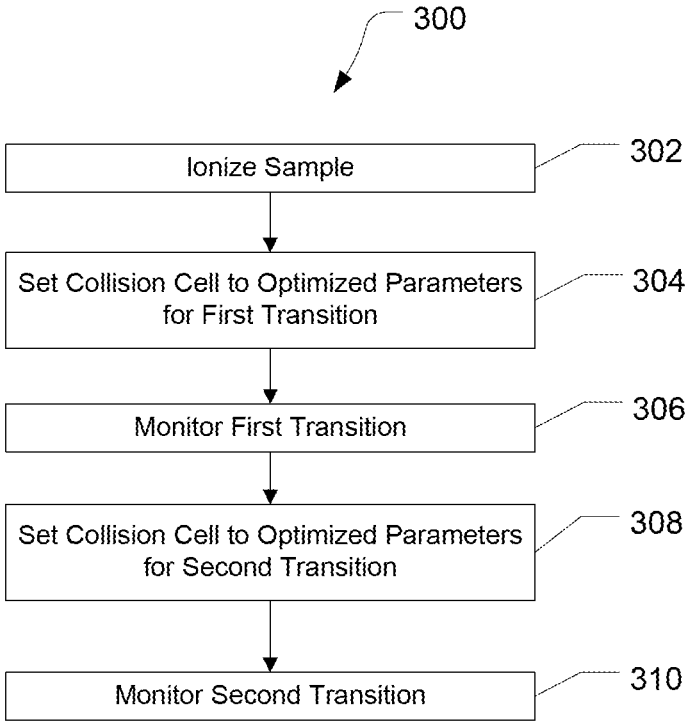

FIG. 3 is a flow diagram illustrating a method 300 of analyzing multiple ion species with using SRM and optimized collision cell RF amplitudes. At 302, a sample can be ionized. At 304, the collision cell can be set to optimized parameters for a first transition (first parent ion-fragment ion pair). At 306, an intensity measurement for the first transition can be obtained. At 308, the collision cell can be set to optimized parameters for a second transition (second parent ion-fragment ion pair). At 308, an intensity measurement for the second transition can be obtained.

In various embodiments, the second transition can be a different fragment of the same parent ion. In other embodiments, the second transition can be a fragment of a different parent ion. In various embodiments, the second parent ion can co-elute with the first parent ion and multiple data points for both the first and second transition can be obtained by alternating between the first set and second set of optimized parameters. Alternatively, the second parent ion can be chromatographically separated from the first parent ion and multiple data points can be obtained for the first transition at the first set of optimized parameters before switching to the second set of optimized parameters to obtain multiple data points for the second transition.

Figure 4:
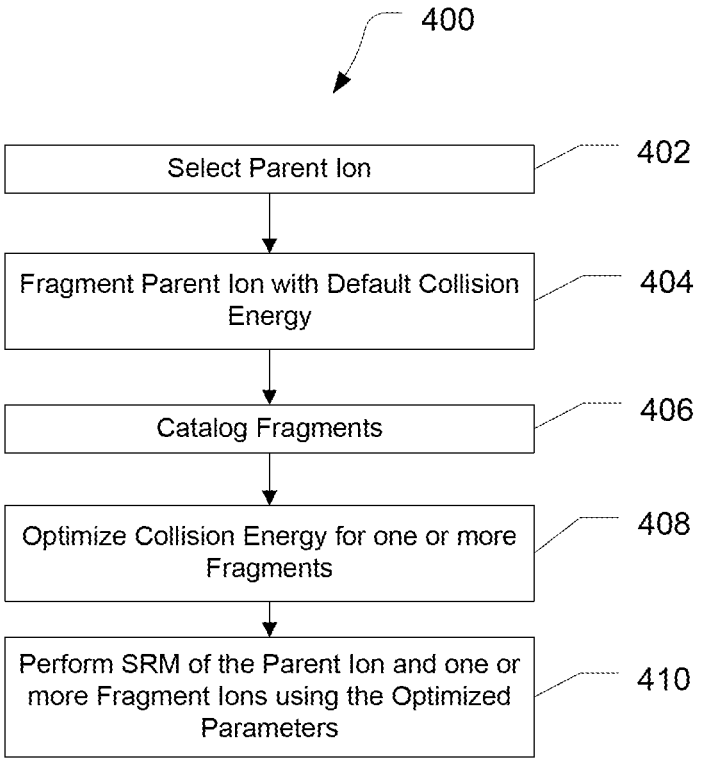
FIG. 4 is a flow diagram illustrating an exemplary method of MS/MS method development, in accordance with various embodiments.

FIG. 4 is a flow diagram illustrating a method 400 of developing an SRM method. At 402, a parent ion is selected based on a mass-to-charge ratio. At 404, the parent ion can be fragmented at a default collision energy. At 406, the fragments produced by fragmenting the parent ion can be cataloged. In various embodiments, the fragments of the parent ion can be cataloged by sweeping a quadrupole mass filter over a m/z change range and recording the m/z at which ions strike a detector. In other embodiments substantially all the fragments may be sent to a time-of-flight mass analyzer or an electrostatic mass analyzer, such as an ORBITTRAP mass analyzer, so that the fragment can be cataloged. In various embodiments, the process of fragmenting a parent ion and cataloging the fragments is referred to as a product search.

At 408, the collision energy can be optimized for one or more of the fragment ions resulting from the fragmentation of the parent ion. In various embodiments, the collision energy can be optimized separately from other parameters, such as entrance lens potential, an exit lens potential, RF amplitude, and collision gas pressure. In other embodiments, a multivariate tuning of parameters such as entrance lens potential, an exit lens potential, RF amplitude, and collision energy can be performed while holding the collision gas pressure constant. In further embodiments, a multivariate tuning of parameters such as entrance lens potential, an exit lens potential, RF amplitude, collision gas pressure, and collision energy can be performed.

At 410, the SRM can be performed to detect and/or quantitate the presence of the parent ion in a sample using the optimized parameters.

Computer-Implemented System

Figure 5:
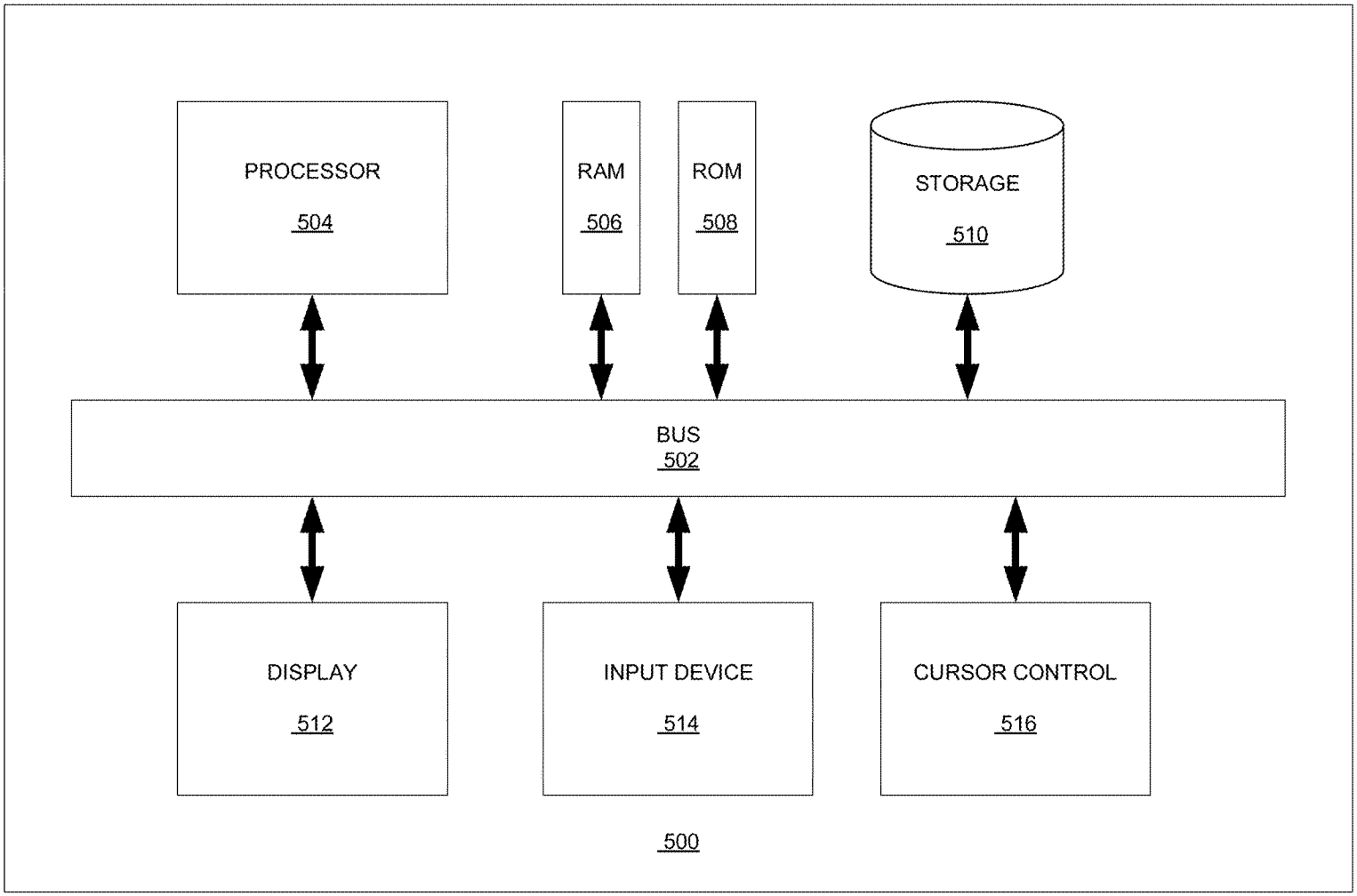
FIG. 5 is a block diagram illustrating an exemplary computer system.

FIG. 5 is a block diagram that illustrates a computer system 500, upon which embodiments of the present teachings may be implemented as which may incorporate or communicate with a system controller, for example controller 108 shown in FIG. 1, such that the operation of components of the associated mass spectrometer may be adjusted in accordance with calculations or determinations made by computer system 500. In various embodiments, computer system 500 can include a bus 502 or other communication mechanism for communicating information, and a processor 504 coupled with bus 502 for processing information. In various embodiments, computer system 500 can also include a memory 506, which can be a random access memory (RAM) or other dynamic storage device, coupled to bus 502, and instructions to be executed by processor 504. Memory 506 also can be used for storing temporary variables or other intermediate information during execution of instructions to be executed by processor 504. In various embodiments, computer system 500 can further include a read only memory (ROM) 508 or other static storage device coupled to bus 502 for storing static information and instructions for processor 504. A storage device 510, such as a magnetic disk or optical disk, can be provided and coupled to bus 502 for storing information and instructions.

In various embodiments, computer system 500 can be coupled via bus 502 to a display 512, such as a cathode ray tube (CRT) or liquid crystal display (LCD), for displaying information to a computer user. An input device 514, including alphanumeric and other keys, can be coupled to bus 502 for communicating information and command selections to processor 504. Another type of user input device is a cursor control 516, such as a mouse, a trackball or cursor direction keys for communicating direction information and command selections to processor 504 and for controlling cursor movement on display 512. This input device typically has two degrees of freedom in two axes, a first axis (i.e., x) and a second axis (i.e., y), that allows the device to specify positions in a plane.

A computer system 500 can perform the present teachings. Consistent with certain implementations of the present teachings, results can be provided by computer system 500 in response to processor 504 executing one or more sequences of one or more instructions contained in memory 506. Such instructions can be read into memory 506 from another computer-readable medium, such as storage device 510. Execution of the sequences of instructions contained in memory 506 can cause processor 504 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 504 for execution. Such a medium can take many forms, including but not limited to, non-volatile media, volatile media, and transmission media. Examples of non-volatile media can include, but are not limited to, optical or magnetic disks, such as storage device 510. Examples of volatile media can include, but are not limited to, dynamic memory, such as memory 506. Examples of transmission media can include, but are not limited to, coaxial cables, copper wire, and fiber optics, including the wires that comprise bus 502.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, etc.

Results

Figure 6:
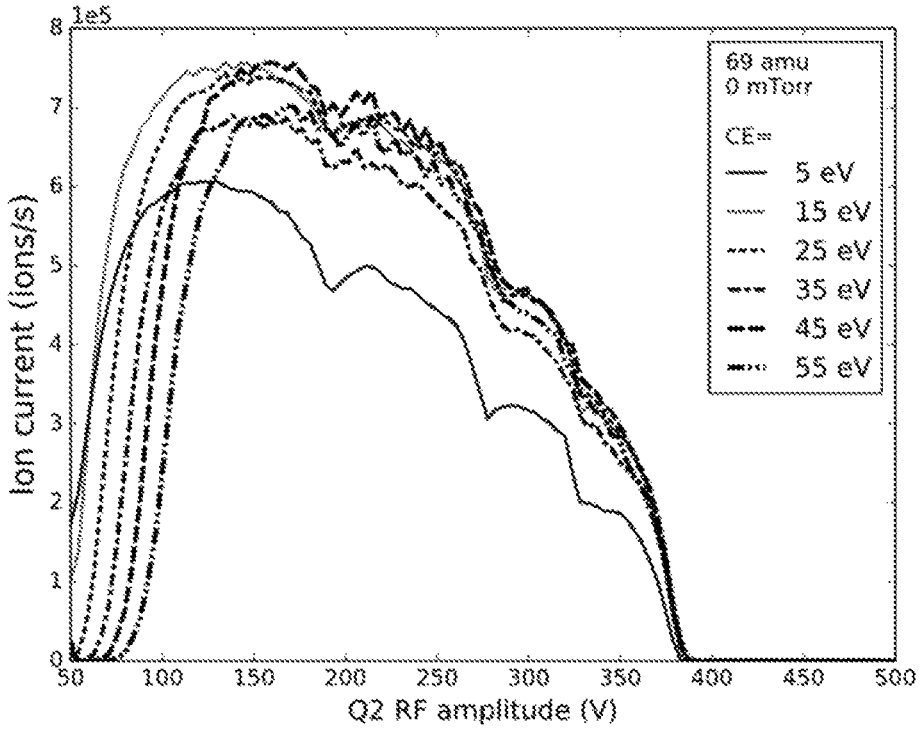
FIGS. 6 through 10 are graphs illustrating the ion current under various conditions, in accordance with various embodiments.
Figure 7:
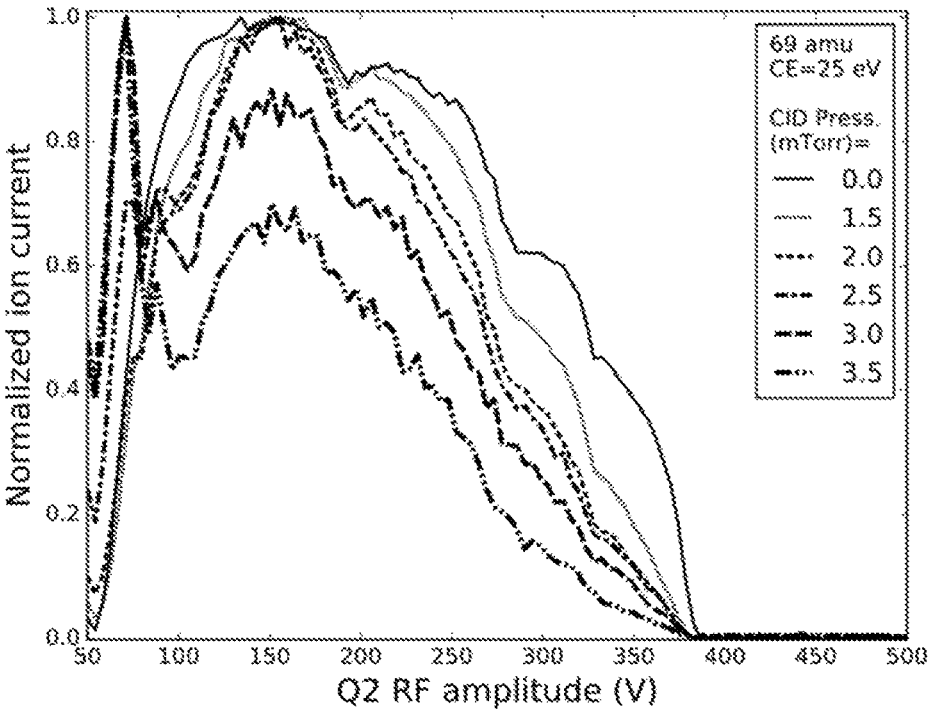

FIG. 6 is a graph illustrating the collision cell RF amplitude tuning curves for $CF_3^-$ (m/z=69) varying the collision energy with no argon in the collision cell. FIG. 7 is a graph illustrating the collision cell RF amplitude tuning curves for $CF_3^-$ (m/z=69) varying the collision gas pressure while holding the collision energy fixed. The "collision energy" is the portion of kinetic energy imparted to the ion by a DC offset of the collision cell regardless of the presence or absence of collision gas in the collision cell.

Figure 8:
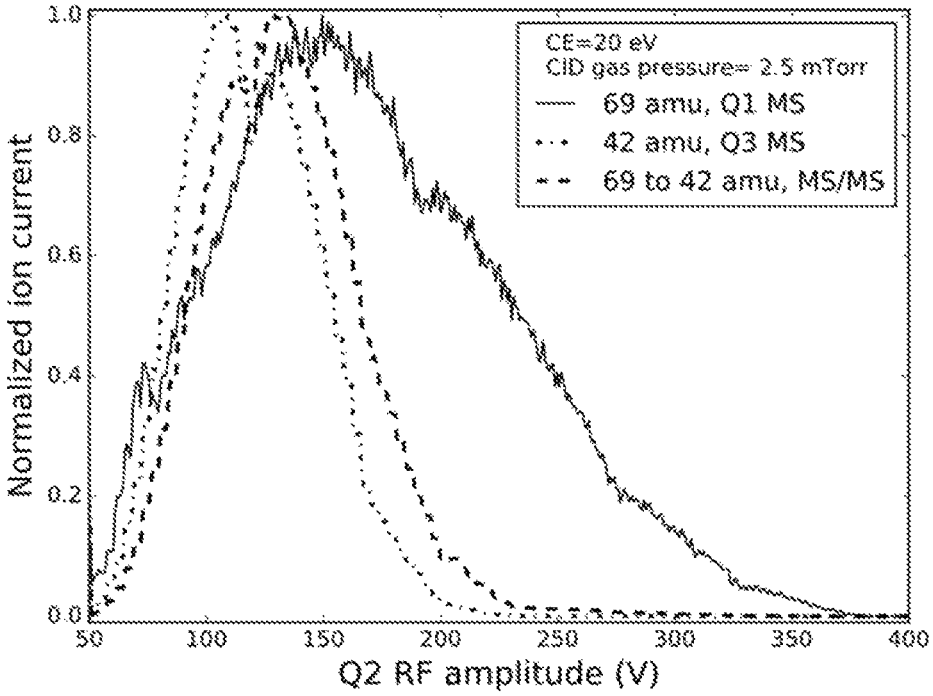

FIG. 8 is a graph illustrating the collision cell RF tuning curve on a TSQ QUANTIVE mass spectrometer for the 69 to 42 amu CID transition of imidazole. Q2 RF amplitude tunings were performed with the collision energy fixed to 20 eV. Difficult-to-fragment ions of nearly identical mass to precursor and product are present in the in the same standard mix. Plotted for comparison are the Q2 RF tunings for acetonitrile (m/z=42) and $CF_3^-$ (m/z=69), obtained with collision gas pressure and collision energy identical to the MS/MS experiments.

Figure 9:
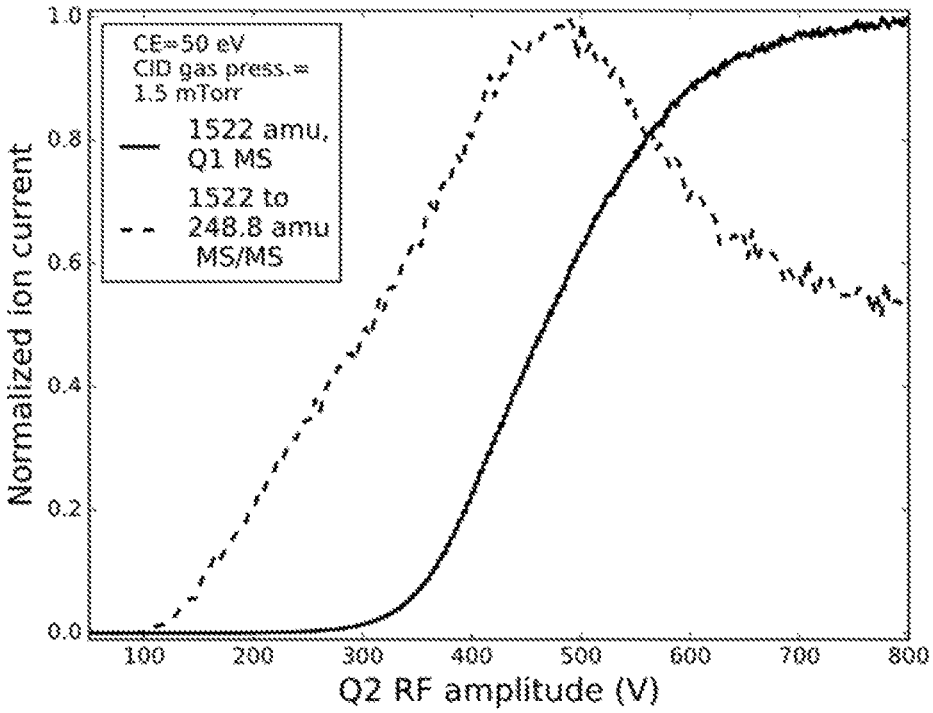

FIG. 9 is a graph illustrating the collision cell RF tuning curves on a TSQ QUANTIVE mass spectrometer for the 1522 to 248.8 amu transition of Ultramark 1522. Q2 RF amplitude tunings were performed with the collision energy fixed to 50 eV. Plotted for comparison is the Q2 RF tuning for Ultramark 1522, obtained with collision gas pressure and collision energy identical to the MS/MS experiments.

FIGS. 8 and 9 demonstrate that optimum tuning falls somewhere between that for the precursor and product mass trading off precursor stability in the collision cell for product stability through the rest of its length and entry into Q3. In the FIG. 8, the difference in tunings appears small—15 V between precursor and MS/MS optimum—but the difference in efficiency is significant, with the MS/MS signal falling off to 80% of its peak at the precursor ion optimum and 75% of its peak at the product ion optimum. In the FIG. 9, 50% of the MS/MS signal is lost at the optimum tuning for the precursor ion.

Figure 10:
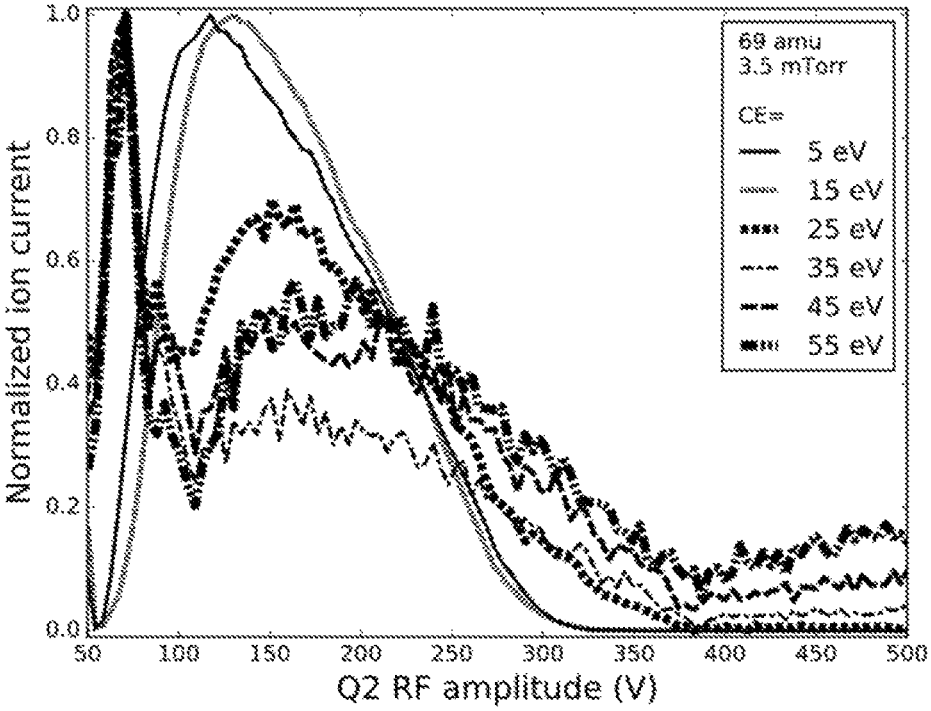

FIG. 10 is a graph illustrating the collision cell RF amplitude tuning curves for $CF_3^-$ (m/z=69) varying the collision energy with 3.5 mTorr of argon in the collision cell. At relatively high gas pressures the relationship between Q2 RF tuning and collision energy becomes complicated, with the shape of the tuning curve changing as more collision energy is applied, in addition to a gradual drift of the local optima.

To account for the coupling between collision energy and collision cell RF optimization and the potential tradeoffs between CID efficiency and ion-optical transmission, collision energy and Q2 RF amplitude should be optimized in tandem.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

What is claimed is:

1. A mass spectrometer comprising:

a collision cell including a plurality of rod pairs configured to generate pseudopotential well through the application of radio frequency potentials to the rod pairs, the collision cell configured to generate a target fragment from a parent ion by colliding the parent ion with one or more gas molecules;

a system controller configured to:

set a radio frequency amplitude of the radio frequency potentials to a default amplitude;

monitor the production of a target fragment ion while adjusting the collision energy;

set the collision energy to optimize the production of the target fragment ion;

apply a linear full range ramp to the radio frequency amplitude to determine an optimal radio frequency amplitude; and set the radio frequency amplitude to the optimal radio frequency amplitude for the parent ion, target fragment ion pair.

2. The mass spectrometer of claim 1, further comprising an ion source and first and second radio frequency mass filters.

3. The mass spectrometer of claim 2, further comprising a collision cell entrance lens between the first radio frequency mass filter and the collision cell, and a collision cell exit lens between the collision cell and the second radio frequency mass filter.

4. The mass spectrometer of claim 1, wherein the system controller is further configured to perform a multidimensional optimization of the radio frequency amplitude and the collision energy.

5. The mass spectrometer of claim 4, wherein the multidimensional optimization includes at least one additional parameter selected from an entrance lens potential and an exit lens potential.

6. The mass spectrometer of claim 4, wherein the multidimensional optimization includes performing successive iterations of Powell's method until the voltage steps are below a desired tolerance.

7. A method for analyzing a sample, comprising:

setting a radio frequency amplitude of a collision cell to a default amplitude;

monitoring the production of a target fragment ion while adjusting a collision energy;

setting the collision energy to optimize the production of the target fragment ion;

applying a linear full range ramp to the radio frequency amplitude to determine an optimal radio frequency amplitude; and setting the radio frequency amplitude to the optimal radio frequency amplitude for the parent ion, target fragment ion pair.

8. The method of claim 7, further comprising performing a multidimensional optimization of the radio frequency amplitude and the collision energy.

9. The method of claim 8, wherein the multidimensional optimization includes at least one additional parameter selected from an entrance lens potential and an exit lens potential.

10. The method of claim 8, wherein the multidimensional optimization includes performing successive iterations of Powell's method until the voltage steps are below a desired tolerance.

11. A mass spectrometer comprising:

an ion source configured to produce a plurality of ions from a sample or calibration source;

a first radio frequency mass filter configured to select parent ions from the plurality of ions;

a collision cell including a plurality of rod pairs configured to generate pseudopotential well through the application of radio frequency potentials to the rod pairs, the collision cell configured to generate a plurality of fragment ions from the parent ions by colliding the parent ions with one or more gas molecules;

a second radio frequency mass filters to select target fragment ions from the plurality of fragment ions;

a collision cell entrance lens between the first radio frequency mass filter and the collision cell, a collision cell exit lens between the collision cell and the second radio frequency mass filter; and a system controller configured to:

set a radio frequency amplitude of the radio frequency potentials to a default amplitude;

monitoring the production of a target fragment ion while adjusting the collision energy;

set the collision energy to optimize the production of the target fragment ion;

apply a linear full range ramp to the radio frequency amplitude to determine an optimal radio frequency amplitude; and set the radio frequency amplitude to the optimal radio frequency amplitude for the parent ion, target fragment ion pair.

12. The mass spectrometer of claim 11, wherein the system controller is further configured to perform a multidimensional optimization of the radio frequency amplitude and the collision energy.

13. The mass spectrometer of claim 12, wherein the multidimensional optimization includes at least one additional parameter selected from an entrance lens potential and an exit lens potential.

14. The mass spectrometer of claim 12, wherein the multidimensional optimization includes performing successive iterations of Powell's method until the voltage steps are below a desired tolerance.

15. A method for automated MS/MS method development, comprising:

performing a product search to identify a parent ion and a fragment ion of the parent ion;

monitoring the production of the fragment ion while performing a multidimensional optimization of collision cell parameters including a collision energy and a radio frequency amplitude of a collision cell;

analyzing a sample by monitoring the production of the fragment ion from the parent ion using the optimized collision cell parameters.

16. The method of claim 15, wherein the multidimensional optimization includes at least one additional parameter selected from an entrance lens potential and an exit lens potential, a voltage offset between the collision cell and a mass analyzer.

17. The method of claim 16, wherein the multidimensional optimization includes performing successive iterations of Powell's method until the voltage steps are below a desired tolerance.

18. The method of claim 16, wherein the multidimensional optimization is performed while holding a collision cell gas pressure constant.

19. The method of claim 16, wherein the multidimensional optimization includes a collision cell gas pressure as an additional parameter.

* * * * *